US006280226B1

(12) United States Patent
Takatsuki et al.

(10) Patent No.: US 6,280,226 B1
(45) Date of Patent: Aug. 28, 2001

(54) CONNECTOR WITH BREAK RESISTANT LOCKING ARM

(75) Inventors: Kozue Takatsuki; Masahiko Aoyama; Masahide Hio, all of Yokkaichi (JP)

(73) Assignee: Sumiwomo Wiring Systems, Ltd. (JP)

( * ) Notice: Subject to any disclaimer, the term of this patent is extended or adjusted under 35 U.S.C. 154(b) by 0 days.

(21) Appl. No.: 09/640,298

(22) Filed: Aug. 16, 2000

(30) Foreign Application Priority Data

Aug. 25, 1999 (JP) ..... 11-238762

(51) Int. Cl.[7] ..... H01R 3/00; H01R 13/627
(52) U.S. Cl. ..... 439/354
(58) Field of Search ..... 439/489, 352, 439/488, 595, 354, 347, 353, 357, 358

(56) References Cited

U.S. PATENT DOCUMENTS 4,993,967 * 2/1991 Matsumoto ..... 439/489

FOREIGN PATENT DOCUMENTS 1-112577 7/1989 (JP) .

* cited by examiner

*Primary Examiner*—Brian Sircus
*Assistant Examiner*—Chandrika Prasad
(74) *Attorney, Agent, or Firm*—Anthony J. Casella; Gerald E. Hespos

(57) ABSTRACT

An electrical connector A has a connector housing (10) with a locking arm (11) formed integrally with an outer surface of the connector housing(11). A thickness Tk of a base part (12) of the locking arm (11) is set larger than a thickness Ta of an arm part (13) thereof. Thus, the flexure rigidity of the base part (12) is greater than that of the arm part (13). When the locking arm (11) tilts in away from the connector housing (10), with the base part (12) acting as the supporting point of the tilting motion of the locking arm (11), the degree of the strain of the base part (12) is low. This is because the base part (12) is less flexible than the arm part (13). A force of tilting the locking arm (11) is relaxed by elastic deformation of the arm part (13), which is more flexible than the base part (12). A stress generated by the tilting of the locking arm (11) does not concentrate on the base part (12), but is dispersed in the arm part (13). Thus, it is possible to prevent the base part (12) from being broken.

15 Claims, 4 Drawing Sheets

CONNECTOR WITH BREAK RESISTANT LOCKING ARM

BACKGROUND OF THE INVENTION

1. Field of the Invention

The present invention relates to a connector having a locking arm.

2. Description of the Related Art

A prior art connector having a locking arm formed integrally with the outer surface of the connector housing is disclosed in Japanese Patent Application Laid-Open No. 1-112577. The locking arm of the prior art connector includes a base part that is erected from the outer surface of the connector housing. The locking arm also includes an arm part that is cantilevered from the base part and that extends along the outer surface of the connector housing. A locking projection is formed on the outer surface of the arm part, which is the surface that does not confront the outer surface of the connector housing. The connector can be connected with a mating connector. During this connection, the locking projection interferes with the hood of the mating connector. As a result, the locking arm flexes elastically toward the outer surface of the connector housing. When both connectors are placed in the normal fit-in state, the locking arm is restored elastically to its original state, and the locking projection is locked to a locking hole of the hood. As a result, both connectors are locked to each other in the normal fit-in state.

The prior art connector housing accommodates metal terminal fittings which are fixed to ends of electric wires. Several such connectors with wires and terminal fittings are combined with each other to produce a wire harness subassembly. Several wire harness subassemblies are packed in a shipping case by piling them up one upon another for transport.

In the connector having the locking arm, a flexure space is provided between the locking arm and the outer surface of the connector housing. The locking arm is cantilevered and extended over the connector housing. Thus, there is a possibility that foreign matter may penetrate into the flexure space between the locking arm and the outer surface of the connector housing.

The wire harness subassemblies are taken out from the shipping case one by one in a place where the wire harness is assembled. At this time, an electric wire of another wire harness subassembly that is still in the shipping case may penetrate into the flexure space and may be caught by the locking arm. If the wire harness subassembly is to be forcibly taken out from the shipping case in this state, the locking arm of the connector caught by the electric wire is subjected to a force of forcibly displacing the locking arm in a direction away from the outer surface of the connector housing, with the locking arm tilting on the base part acting as the supporting point.

In this event, there is a possibility that the locking arm of the conventional connector can be broken at its base part even though the displacement amount of the locking arm is not very great.

The present invention has been made in view of the above-described situation. Thus, it is an object of the present invention to provide a connector capable of preventing breakage of a locking arm displaced in away from the connector housing.

SUMMARY OF THE INVENTION

The subject invention is directed to a connector having a connector housing and a locking arm formed integrally with an outer surface of the connector housing. The locking arm includes a base part erected from the outer surface of the connector housing. An arm part is cantilevered from the base part and extends almost parallel with the outer surface of the connector housing. A flexure space is provided between the outer surface of the connector housing and an inner surface of the arm part. The flexure space permits the arm part to flex elastically when the connector and a mating connector are locked to each other. In this construction, the thickness of the base part is set larger than that of the arm part.

It is preferable that the surface of the base part that is continuous with the inner surface of the arm part and with the outer surface of the connector housing consists of a substantially cylindrically generated arc-shaped surface.

As explained above, the prior art locking arm is broken at its base part when the locking arm tilts away from the outer surface of the connector housing, with the base part acting as the supporting point of the tilting motion of the locking arm. It is conceivable that this breakage occurs because the base part has a great increase in the rate of strain relative to change in the tilting angle of the locking arm.

In consideration of this possible cause for the breakage in the prior art, the connector of the present invention has a base part with a thickness that is set larger than the thickness of the arm part. Hence, it is possible to allow the base part to be less flexible than the arm part and thus suppress the increase of the strain of the base part. Further, the force of tilting the locking arm is relaxed by elastic deformation of the arm part that is more flexible than the base part.

The rear surface of the base part that is continuous with the inner surface of the arm part and with the outer surface of the connector housing is formed as the substantially cylindrically-generated arc-shaped surface. Thus, rear surface of the base part has a larger radius of curvature than that of a surface formed in combination of a curved surface and a flat surface. Consequently, it is possible to prevent the stress from being convergently applied to the rear surface of the base part.

DETAILED DESCRIPTION OF THE PREFERRED EMBODIMENTS

Figure 1:
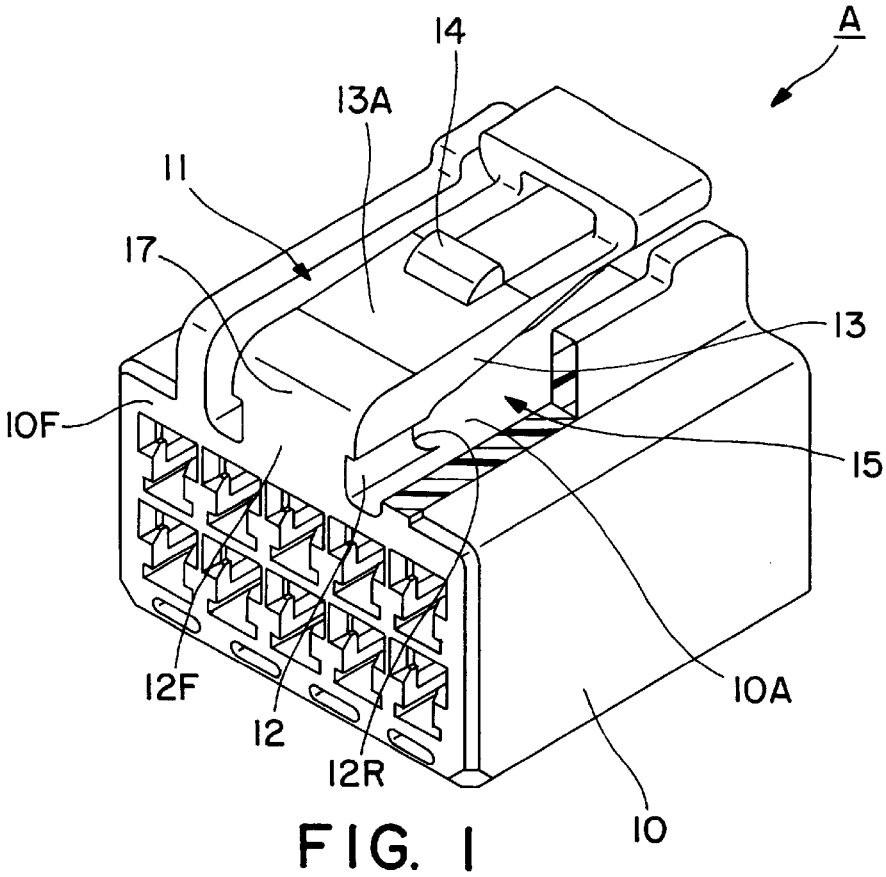
FIG. 1 is a perspective view showing a connector of a first embodiment of the present invention.

A connector in accordance with the first embodiment of the subject invention is identified generally by the letter A in FIGS. 1–7. The connector A includes a connector housing 10 made of a synthetic resin. A locking arm 11 is formed integrally with an outer surface of the connector housing 10. The locking arm 11 includes a base part 12 erected from a front end 10F of an outer surface 10A of the connector housing 10. An arm part 13 is cantilevered from the upper end of the base part 12 and extends rearward along the outer surface 10A of the connector housing 10. A locking projection 14 is formed on an outer surface 13A of the arm part 13, which is the surface not confronting the outer surface 10A of the connector housing 10. A flexure space 15 is provided between an inner surface 13B of the arm part 13 and the outer surface 10A of the connector housing 10 for permitting an elastic flexing of the arm part 13.

The connector A and a mating connector (not shown) can be mated with each other. During this mating, the locking projection 14 interferes with an inner peripheral surface of a hood of the mating connector. As a result, the locking arm 11 flexes elastically such that the arm part 13 tilts on the base part 12, which acts as the supporting point of the tilting motion of the arm part 13. The arm part 13 then approaches the outer surface 10A of the connector housing 10. When both connectors are placed in a normal fit-in state, the locking arm 11 is restored elastically to its original state, and the locking projection 14 is locked to a locking hole (not shown) of the hood. As a result, both connectors are locked to each other in the normal fit-in state.

Metal terminal fittings (not shown) are fixed to ends of electric wires (not shown). The metal terminal fittings then are inserted into the rear of the connector housing 10. The connector A is combined with other connectors and wires to produce a wire harness subassembly. Several such wire harness subassemblies are packed in a shipping case for transport. In a wire harness-installing or assembling place, the connector A that is installed on one wire harness subassemblies is taken out from the shipping case. At this time, there is a possibility that an electric wire of another wire harness subassembly will penetrate into the flexure space 15 between the connector housing 10 and the locking arm 11 and will be caught by the arm part 13. If the wire harness subassembly is to be forcibly taken out from the shipping case in this state, the locking arm 11 caught by the electric wire is subjected to a force of forcibly displacing the locking arm 11 in direction away from the outer surface 10A of the connector housing 10, with the locking arm 11 tilting upward and with the base part 12 acting as the supporting point. In this event, in the conventional connector, there is a possibility that the locking arm will be broken at its base part even though the displacement amount of the locking arm is not very great. However, in the first embodiment, the connector is constructed so that the locking arm 11 can be prevented from being easily broken. The construction of the locking arm 11 will be described in detail below.

A front surface 12F of the base part 12 of the locking arm 11 faces a direction opposite to the extension direction of the arm part 13 and is flat. The front surface 12F receives a compression load when the locking arm 11 tilts upward, namely, in a direction away from the connector housing 10. The base (lower end in FIG. 2) of the front surface 12F of the base part 12 is continuous and flush with the front end 10F of the connector housing 10. The front surface 12F of the base part 12 has an upper end that is continuous with the outer surface 13A of the arm part 13 through a substantially cylindrically generated arc-shaped surface 17. Additionally, the front surface 12F is almost perpendicular to the outer surface 13A.

The rear surface of the base part 12, namely, the surface thereof continuous with the inner surface 13B of the arm part 13 and with the outer surface 10A of the connector housing 10 is formed as a substantially cylindrically generated arc-shaped surface 12R having a uniform curvature. More specifically, the cylindrically generated arc-shaped surface 12R is a semicylindrical arc that is continuous with the inner surface 13B of the arm part 13 and with the outer surface 10A of the connector housing 10, such that the inner surface 13B of the arm part 13 and the outer surface 10A of the connector housing 10 are tangent to the arc-shaped surface 12R.

The front half region of the arm part 13 that is forward of the locking projection 14 and continuous with the base part 12 has an approximately uniform thickness. The rear half region of the arm part 13 becomes gradually thinner toward the rear end thereof, because the inner surface 13B is inclined to be gradually more distant from the outer surface 10A of the connector housing 10.

Figure 2:
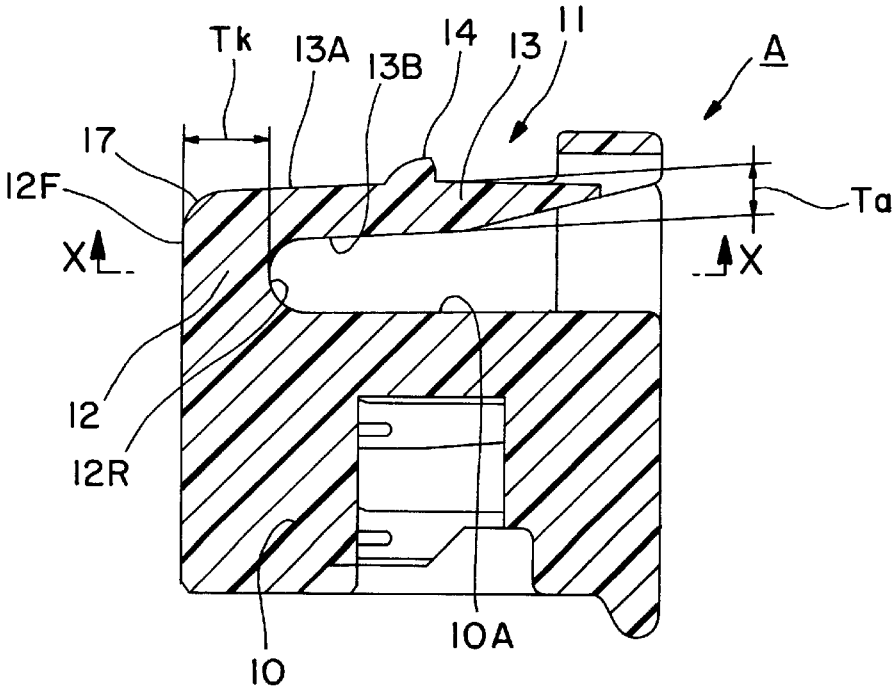
FIG. 2 is a longitudinal sectional view showing the connector.
Figure 3:
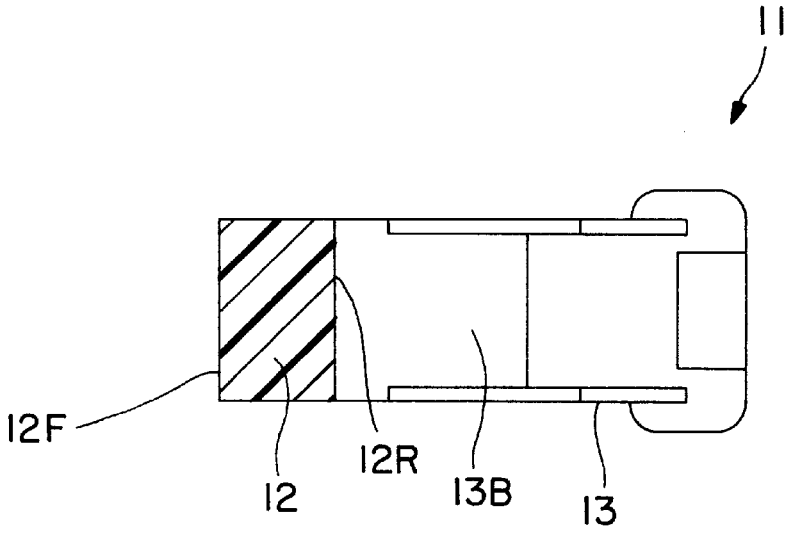
FIG. 3 is a sectional view taken along a line 3—3 of FIG. 2.
Figure 4:
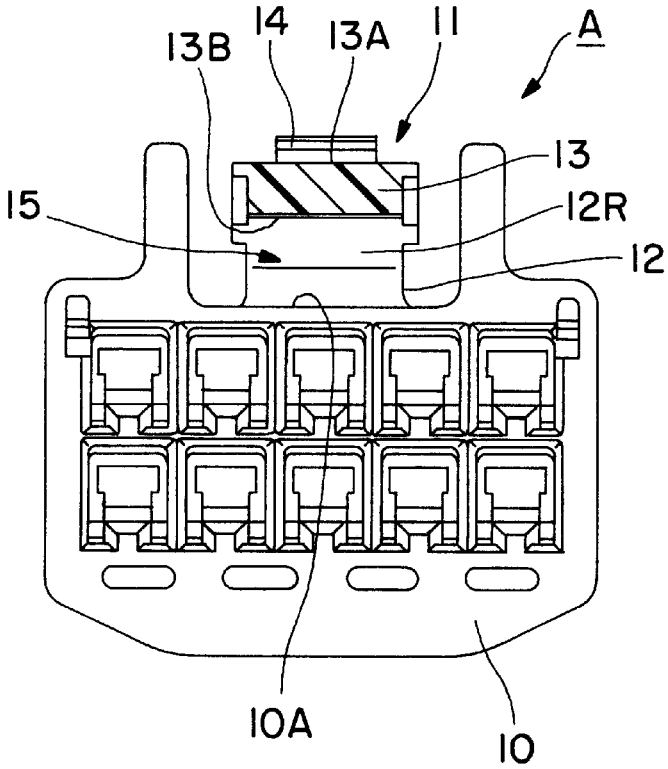
FIG. 4 is a rear view showing the connector in a state in which a locking arm is broken away.
Figure 5:
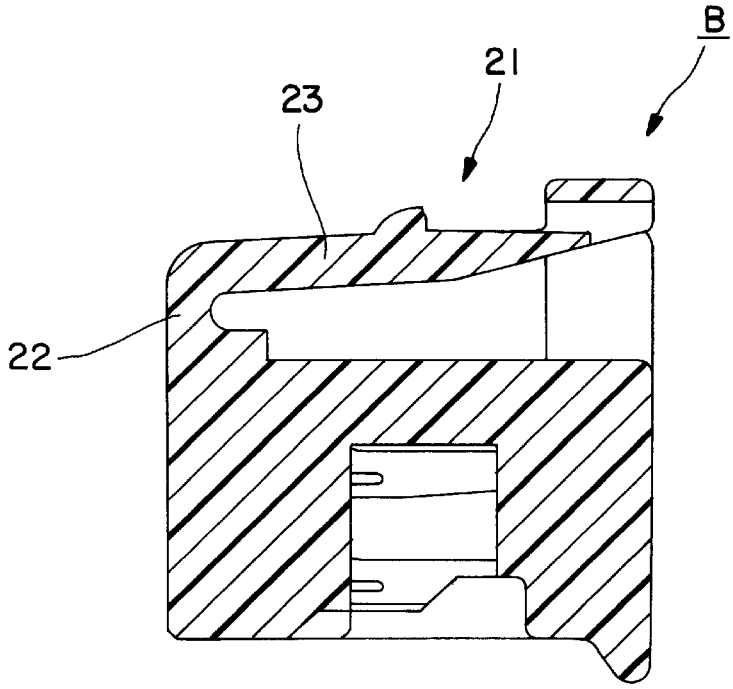
FIG. 5 (PRIOR ART)
FIG. 5 is a sectional view showing a conventional connector.

A thickness shown with Tk in FIG. 2 is the shortest of the longitudinal thicknesses between the front surface 12F of the base part 12 and the rear surface thereof, and lies centrally on the semi-cylindrical arc-shaped surface 12R. The shortest thickness Tk is about twice as large as a uniform thickness Ta, which is the vertical thickness between the outer surface 13A of the arm part 13 and the inner surface 13B thereof on the front half region of the arm part 13. The shortest thickness Tk of the base part 12 is the thickness between its front surface 12F and a straight line parallel to the front surface 12F and tangent to the cylindrically generated arc-shaped surface 12R. The horizontal line corresponding to the shortest thickness Tk passes through a point located at about the center of the base part 12 in its vertical direction. Needless to say, longitudinal thicknesses of the base part 12 measured in upper and lower regions of the base part 12 with respect to the center of the base part 12 in its vertical direction are larger than the shortest thickness Tk.

The operation of the first embodiment is described below.

As explained above, there is the potential that the locking arm 11 will be broken at its base part 12 when the locking arm 11 is subjected to a force for displacing the locking arm 11 upward from the connector housing 10, with the locking arm 11 tilting on the base part 12 acting as the supporting point of the tilting motion of the locking arm 11. It is conceivable that such a breakage could be caused because the base part 12 has a great increase in the rate of strain relative to change in the tilting angle of the arm part 13. During the tilting motion of the base part 12, a stress is convergently applied to the base part 12.

In consideration of the above situation, according to the first embodiment, the shortest thickness Tk of the base part 12 is set larger than the thickness Ta of the arm part 13. Consequently, it is possible to allow the base part 12 to be less flexible than the arm part 13 and thus suppress the increase of the strain of the base part 12. Further, the force of tilting the locking arm 11 is relaxed by elastic deformation of the arm part 13, which is more flexible than the base part 12. That is, the stress generated by tilting the locking arm 11 does not concentrate on the base part 12, but is dispersed widely in the arm part 13. As a result, it is possible to prevent the base part 12 from being broken.

There is a fear that the stress is increasingly applied to the arm part 13 because the arm part 13 is more flexible than the base part 12. However, because the arm part 13 is long in the front-to-back direction of the connector housing 10, the stress is dispersed widely in the arm part 13. Accordingly, the stress is not applied locally to the arm part 13 and there is no possibility that the arm part 13 is broken.

Further, the rear surface of the base part 12 that is continuous with the inner surface 13B of the arm part 13 and with the outer surface 10A of the connector housing 10 is formed as a substantially cylindrical generated arc-shaped surface 12R. Thus the rear surface of the base part 12 has a larger radius of curvature than that of a surface formed in combination of a curved surface and a flat surface. Thus, it is possible to prevent the stress from being convergently applied to the rear surface of the base part 12 and this configuration allows the base part 12 to have an improved breakage prevention function.

Figure 6:
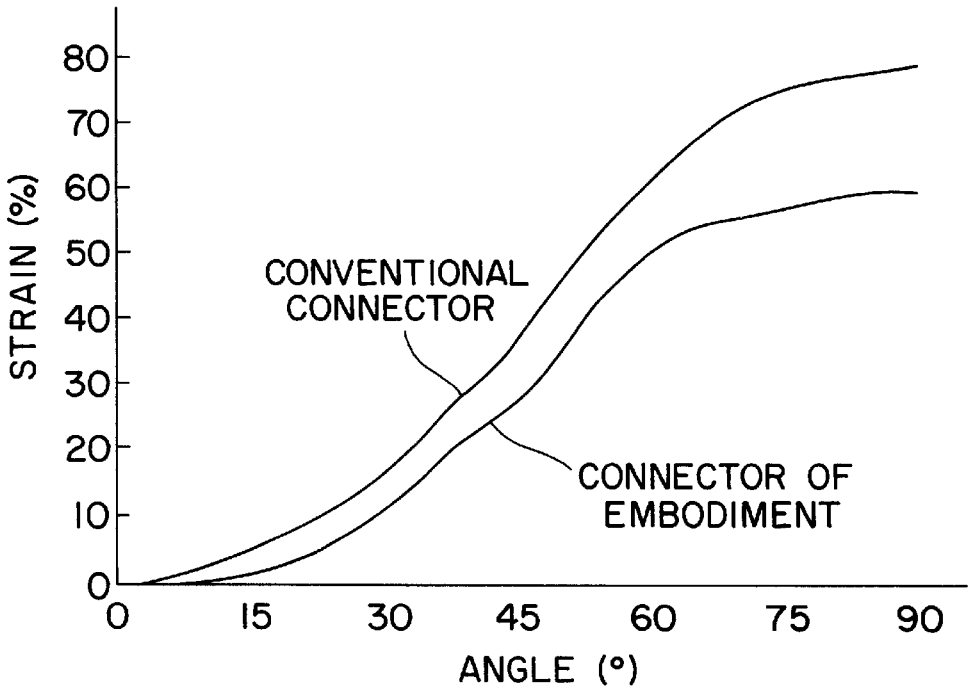
FIG. 6 is a graph showing the correlation between the angle of tilting of an arm part, with a base part acting as the supporting point and a maximum strain of a locking arm.

FIG. 6 shows a graph indicating the result of tests conducted on the connector housing A of the first embodiment made of PBT and a conventional connector B (shown in FIG. 5) made of PBT. The tests were conducted to investigate the correlation between the angle of tilting made by the arm part 13, with the base part 12 acting as the supporting point of the tilting motion of the arm part 13 and the maximum strain of the locking arm 11 in the connector housing A. The tests also were conducted to investigate the correlation between the angle of tilting made by an arm part 23, with a base part 22 acting as the supporting point of tilting made by the arm part 23 and the maximum strain of a locking arm 21 in the conventional connector B. In the conventional connector B, the thickness of the base part 22 was almost equal to that of the arm part 23. The graph indicates that if the tilting angle of the arm part 13 is equal to that of the arm part 23, the maximum strain value of the connector A of the first embodiment is smaller than that of the conventional connector B. This means that the locking arm 11 of the connector A of the first embodiment has a stress dispersion degree higher than that of the locking arm 21 of the conventional connector B.

Figure 7:
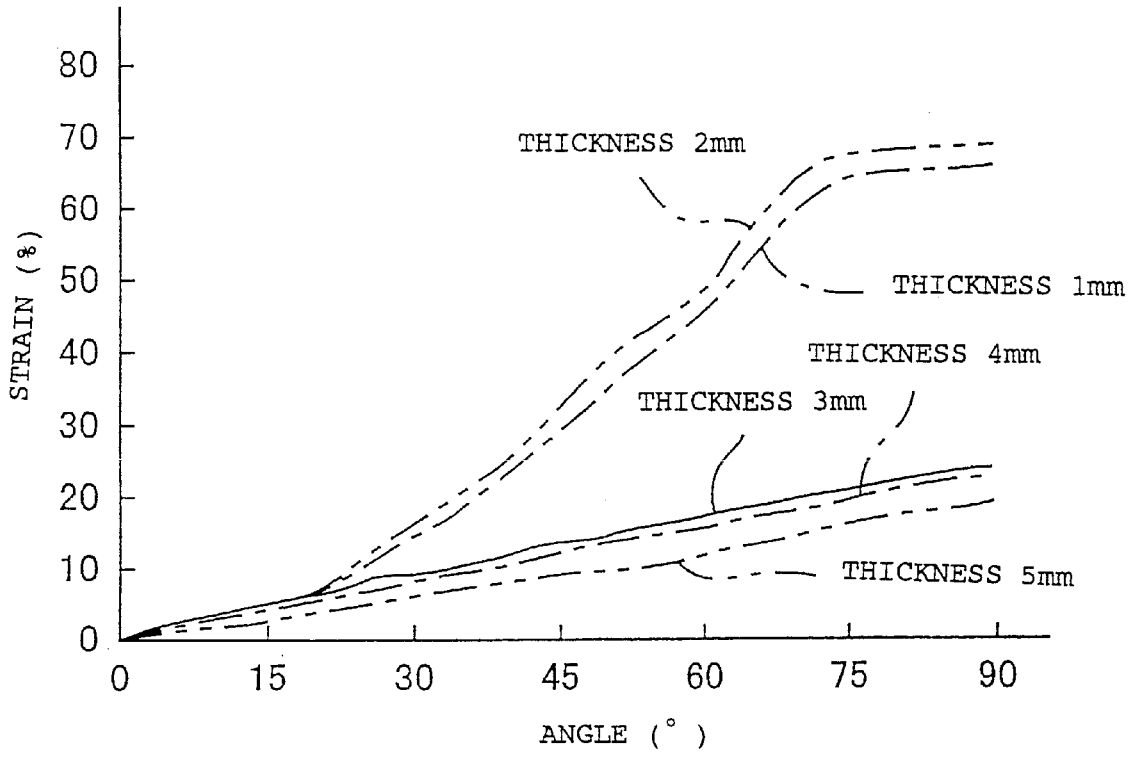
FIG. 7 is a graph showing the correlation between the thickness of the base part and strain.

FIG. 7 is a graph showing the result of the test conducted to investigate the correlation between an angle of tilting made by the arm part, with the base part acting as the supporting point of the tilting motion of the arm part and a maximum strain of the base part. In the test, five kinds of locking arms were prepared. The width of the base part and the arm part of each locking arm was 6.5 mm. The thickness of the arm part of each locking arm was 2.3 mm. The radius of the cylindrically generated arc-shaped surface of the base part of each locking arm was 0.84 mm. Only the minimum thicknesses of the base parts of the five locking arms were different from one another. They were 1 mm, 2 mm, 3 mm, 4 mm, and 5 mm. The graph indicates that if the tilting angles of the five locking arms are equal to each other, each locking arm in which minimum thickness of the base part is smaller than the thickness 2.3 mm of the arm part has a large strain, whereas each locking arm in which minimum thickness of the base part is larger than the thickness 2.3 mm of the arm part has a small strain.

The present invention is not limited to the embodiment explained by way of the above description and drawings. For example, the following embodiments are included in the technical scope of the present invention. Further, various modifications can be made without departing from the spirit and scope of the present invention.

In the preferred embodiment, the shortest thickness of the base part is set about twice as large as the thickness of the arm part. But according to the present invention, the ratio of the thickness of the base part to that of the arm part can be determined as desired provided that the base part is thicker than the arm part.

In the preferred embodiment, the rear surface of the base part is formed as the cylindrically generated arc-shaped surface having a uniform curvature. But according to the present invention, the rear surface of the base part may have a flat portion, such as a combination of a flat surface and at least one curved surface. Furthermore, the arc-shaped surface can be a surface of revolution other than a cylinder, such as a surface, which, in cross-section defines an elliptical arc, a hyperbola, a parabola or the like.

What is claimed is:

1. A connector having a connector housing and a locking arm formed integrally with an outer surface of said connector housing, said locking arm including a base part erected from said outer surface of said connector housing; an arm part cantilevered from said base part and extending almost parallel with said outer surface of said connector housing; and a flexure space provided between said outer surface of said connector housing and an inner surface of said arm part, said flexure space enabling said arm part to flex elastically when said connector and a mating connector are locked to each other, wherein the base part has a narrow portion adjacent said outer surface of said connector housing and a wide portion spaced from said outer surface of said connector housing, the wide portion and the narrow portion of the base part each defining widths measured transverse to the arm part, said width of said narrow portion being less than said width of said wide portion, said arm part defining a width adjacent said base part equal to said width of said wide portion of said base part, a thickness of said base part measured parallel to said arm part is set larger than a thickness of said arm part measured perpendicular to said outer surface of said connector housing.

2. A connector according to claim 1, wherein a surface of said base part continuous with said inner surface of said arm part and with said outer surface of said connector housing consists of a substantially cylindrically generated arc-shaped surface.

3. A connector according to claim 2, wherein said substantially cylindrically generated arc-shaped surface is substantially tangent with the inner surface of said arm part and with said outer surface of said connector housing.

4. A connector according to claim 3, wherein said arm part includes an end remote from the base part, the end of the arm part being gradually thinned such that said inner surface of said arm part closer to said end is gradually further from the outer surface of the connector housing and an outer surface of said arm part being tapered toward said outer surface of said connector housing at location in proximity to said end of said arm part.

5. A connector according to claim 1, wherein base part includes a front surface facing oppositely from said arm part and aligned substantially perpendicular to said arm part.

6. A connector having a connector housing unitarily molded from a plastic resin and having a front end, a rear end and terminal cavities extending therethrough, said connector housing further having an upper surface extending substantially from said front end to said rear end of said connector housing, a locking arm unitarily molded with said connector housing and having a base part projecting upwardly from said upper surface substantially at the front end of said connector housing, an arm part projecting rearwardly from said base part and in spaced relationship to said upper surface to define a flexure space between said upper surface of said connector housing and said arm part, a locking projection formed on a surface of said arm part facing away from said upper surface of said connector housing and disposed at a location aligned intermediate said front and rear ends of said connector housing, the base part having a narrow portion adjacent said outer surface of said connector housing and a wide portion spaced from said outer surface of said connector housing, the wide portion and the narrow portion of the base part each defining widths measured transverse to the arm part, said width of said narrow portion being less than said width of said wide portion, said arm part defining a width adjacent said base part equal to said width of said wide portion of said base part, said base part defining a minimum thickness measured in a front-to-rear direction, said arm part defining a thickness at locations forwardly of said locking projection, the thickness of said base part being greater than the thickness of the arm part.

7. A connector according to claim 6, wherein the thickness of the base part is substantially twice the thickness of the arm part.

8. A connector according to claim 7, wherein the arm part has an upper surface facing away from the connector housing and a lower surface facing the connector housing, and wherein portions of the arm part rearwardly of the locking projection are gradually thinned at locations further from the front end of the connector housing, the thinned portions being defined by tapering both said upper surface and said lower surface of the arm part toward one another.

9. A connector according to claim 7, wherein the base part has a rear surface facing the flexure space, the rear surface defining a substantially concave curved surface.

10. A connector according to claim 9, wherein the curved surface is substantially cylindrically generated.

11. A connector according to claim 10, wherein the curved surface is substantially tangent to the outer surface o the connector housing and substantially tangent to the inner surface of the arm part.

12. A connector having a connector housing unitarily molded from a plastic resin, said housing including opposed front and rear ends and terminal cavities extending between said ends, an outer surface being formed on said housing and extending substantially between said opposed ends, a locking arm formed unitarily with the connector housing and including a base part projecting unitarily upwardly from said outer surface at a location substantially adjacent said front end of said connector housing, an arm part cantilevered rearwardly from a location on said base part spaced from said outer surface of said connector housing, said arm part being spaced from said outer surface to define a flexure space therebetween, the base part having a narrow portion adjacent said outer surface of said connector housing and a wide portion spaced from said outer surface of said connector housing, the wide portion and the narrow portion of the base part each defining widths measured transverse to the arm part, said width of said narrow portion being less than said width of said wide portion, said arm part defining a width adjacent said base part equal to said width of said wide portion of said base part, said base part defining a minimum thickness measured parallel to said outer surface in a front-to-rear direction on said connector housing, said arm part defining a maximum thickness measured substantially perpendicular to the outer surface, the maximum thickness of the arm part being sufficiently less than the minimum thickness of the base part such that the arm part is substantially more flexible than the base part, thereby causing said arm part to flex more than the base part in response to forces urging said arm part away from said outer surface of said connector housing.

13. A connector according to claim 4, further comprising a concave curved side surfaces between said narrow portion of said base part and said outer surface of said connector housing, said concave curved side surfaces being generated about axes aligned generally parallel to said arm part.

14. A connector according to claim 4, wherein the arm part includes opposed side edges extending between the inner surface and the outer surface of the arm part, the outer surface of the arm part being tapered toward the inner surface of the arm part at locations spaced inwardly from the sides of the arm part.

15. A connector according to claim 4, wherein portions of said arm part of said locking arm spaced from said base part and adjacent the inner surface of the arm part are narrowed to a width substantially equal to the width of the narrow portion of the base part.

* * * * *